US005632107A

United States Patent [19]

Meng-Suen et al.

[11] Patent Number: 5,632,107

[45] Date of Patent: May 27, 1997

[54] DISPLAY WITH UNDULATING RIGID TRACK ON WHICH A BALANCING FIGURE TRAVELS

[75] Inventors: Huang Meng-Suen; Arthur Liu, both of Kowloon, Hong Kong; Charles Savard, Collierville, Tenn.

[73] Assignee: Mr. Christmas, Inc., New York, N.Y.

[21] Appl. No.: 538,859

[22] Filed: Oct. 4, 1995

[51] Int. Cl.[6] ..... G09F 19/00

[52] U.S. Cl. ..... 40/430; 472/7; 472/8; 472/10

[58] Field of Search ..... 472/6, 7, 8, 9, 472/10, 12, 37, 36; 40/414, 415, 430, 427

[56] References Cited

U.S. PATENT DOCUMENTS 1,000,219 8/1911 West ..... 472/6

3,100,946 8/1963 Swanberg et al. ..... 40/415 X

*Primary Examiner*—Kien T. Nguyen

*Attorney, Agent, or Firm*—Fitzpatrick, Cella, Harper & Scinto

[57] ABSTRACT

An undulating display includes a rigid track, a pair of linking members secured to the track, a first pivot member having first pivot axis and a second pivot axis, and a second pivot member pivotally supported on the second pivot axis of the first pivot member. The pair of linking members is secured to the second pivot member. The display also includes an drive mechanism for pivoting simultaneously the second pivot member about the second pivot axis and the first pivot member about the first pivot axis thereby to produce undulating motion of the track.

27 Claims, 9 Drawing Sheets

DISPLAY WITH UNDULATING RIGID TRACK ON WHICH A BALANCING FIGURE TRAVELS

BACKGROUND OF THE INVENTION

1. Field of the Invention

This invention pertains to an animated display with a moving figure, and more particularly to a motorized display allowing the figure to balance on, and continuously travel around, a rigid track. The display may be mounted on a vertical support, or may be supported on a flat surface. In one application, the display can even be supported on the trunk of a Christmas tree.

2. Description of the Prior Art

Animated displays have entertained adults and children for generations. Displays with moving figures are particularly enjoyable, and can be made even more exciting by requiring the moving figure to be balanced.

Animated displays having balancing toys alone are known. For example, U.S. Pat. No. 70,850 (Humans) discloses an automatic tight-rope walker toy. A rod connects the body of a figure to a wheel or pulley grooved to run upon a cord. Cranks attached to each end of the axis of the wheel or pulley are attached to the feet of the figure to give the figure the appearance of walking when the wheel or pulley rolls along the cord.

U.S. Pat. No. 849,280 (Stevens) relates to a mechanical wheel-rider toy. To rotate the wheel, a spring (either a coil spring or an elastic material) is wound about the wheel axle by rotating the wheel. The toy is then placed on a smooth surface and, after being started by hand movement, is let go. Thereupon, the toy rolls forward driven by the tension of the spring.

U.S. Pat. No. 2,349,492 (Eakin) relates to an animated figure mounted on a wheel. The animated figure is attached to the wheel so as to appear to be pedalling as the wheel rotates. An actuating apparatus includes a circular table permitted to wobble by the action of radially disposed springs. A "rotary spider" mounted beneath the table supports the table with radially disposed arms of different lengths for wobbling the table as the spider is rotated. If the spider is rotated at a uniform speed, the animated figure mounted on the wheel and having a frusto-conical wheel tread is said to continuously move in a circle.

U.S. Pat. No. 3,108,397 (Shanks) relates to a balancing monorail figure toy that includes an attachment that may be used to balance a figure on a tight wire. The attachment includes an inverted, generally U-shaped base member. A grooved wheel is positioned between the downwardly extending legs of the base member, and is secured thereto by a shaft. This attachment is secured to a figurine, for example. In operation, the grooved wheel may be set on an inclined tight wire to allow the figurine to roll down the wire.

The known animated displays discussed above have certain limitations, among other things, in the way movement of the balancing figures is achieved. Therefore, an improved animated display capable of moving a balancing toy, or figure, is desirable.

Moreover, while many animated displays are available for holiday decorating, Christmas trees are generally decorated only with ornaments mounted in fixed locations and with strings of lights. An animated display with a moving figure supported on the tree could add to its festive appearance.

SUMMARY OF THE INVENTION

For purposes of explanation, the present invention will be described with reference to a Christmas holiday figure, Santa, which travels on a rigid hoop, or track, mounted to a Christmas tree or displayed on a flat surface. However, this invention more broadly relates to a display having a rigid track which oscillates in a manner to continuously support and propel an animated toy. An entertaining aspect of the invention is the continuous movement of the figure achieved by transmitting driving force from a motor to the rigid track on which the figure travels.

A principal object of the present invention is to provide an animated display on which a figure travels continuously around an undulating rigid track.

Another object of the invention is to provide an animated display that can be attached to a Christmas tree.

Still another object of the invention is to provide an animated display that can be supported on a flat surface.

Yet another object of the invention is to provide a rigid track that can be undulated by a drive mechanism in a simple and reliable manner.

In order to achieve these objects, one aspect of the present invention is directed to a display having a rigid track, a motion-transmitting mechanism for imparting motion to the rigid track, the motion-transmitting mechanism including a compound pivot mechanism pivoting about first and second transverse axes, one or more links structurally connecting the rigid track to the compound pivot mechanism, and a frame supporting the motion-transmitting mechanism.

Another aspect of the invention is directed to an undulating display that includes a rigid, continuous, closed track; and a motion-transmitting apparatus for imparting undulating motion to the rigid track. The motion-transmitting apparatus has a compound pivot mechanism producing continuous, simultaneous pivoting motion about a fixed first axis and about a second axis, which is skewed with respect to said first axis and also pivots with respect to said first axis. A connecting structure connects the rigid track to the compound pivot mechanism to pivot about said second axis. Continuous simultaneous pivoting motion produced by the compound pivot mechanism about the first and second axes imparts undulating motion to the track.

In another aspect of the invention is directed to a display having a rigid, continuous, closed track, and a undulation drive apparatus, connected to the track, for moving the track in an undulating manner. A figurine is configured to roll on the track. The figurine is driven around the track by the undulating motion thereof.

In still another aspect of the invention, a display device comprises a rigid continuous, closed track. Motion-transmitting apparatus imparts continuous undulating motion to the track and includes a compound pivot mechanism defining a first fixed axis, a first pivot member mounted to pivot reciprocally about the first axis and a defining a second axis skewed with respect to said first axis, a second pivot member mounted to pivot reciprocally about said second axis, and a drive device for simultaneously driving the second pivot member to pivot continuously reciprocally about the second axis and the first pivot member to pivot continuously reciprocally about the first axis. A connecting structure connects the track to the second pivot member such that simultaneous drive of the first and second pivot members by the drive means imparts continuous undulating motion to the track.

These and other objects, aspects, features and advantages of the present invention will become apparent from the following detailed description of the preferred embodiments taken in conjunction with the accompanying drawings.

DESCRIPTION OF THE PREFERRED EMBODIMENTS

Figure 1:
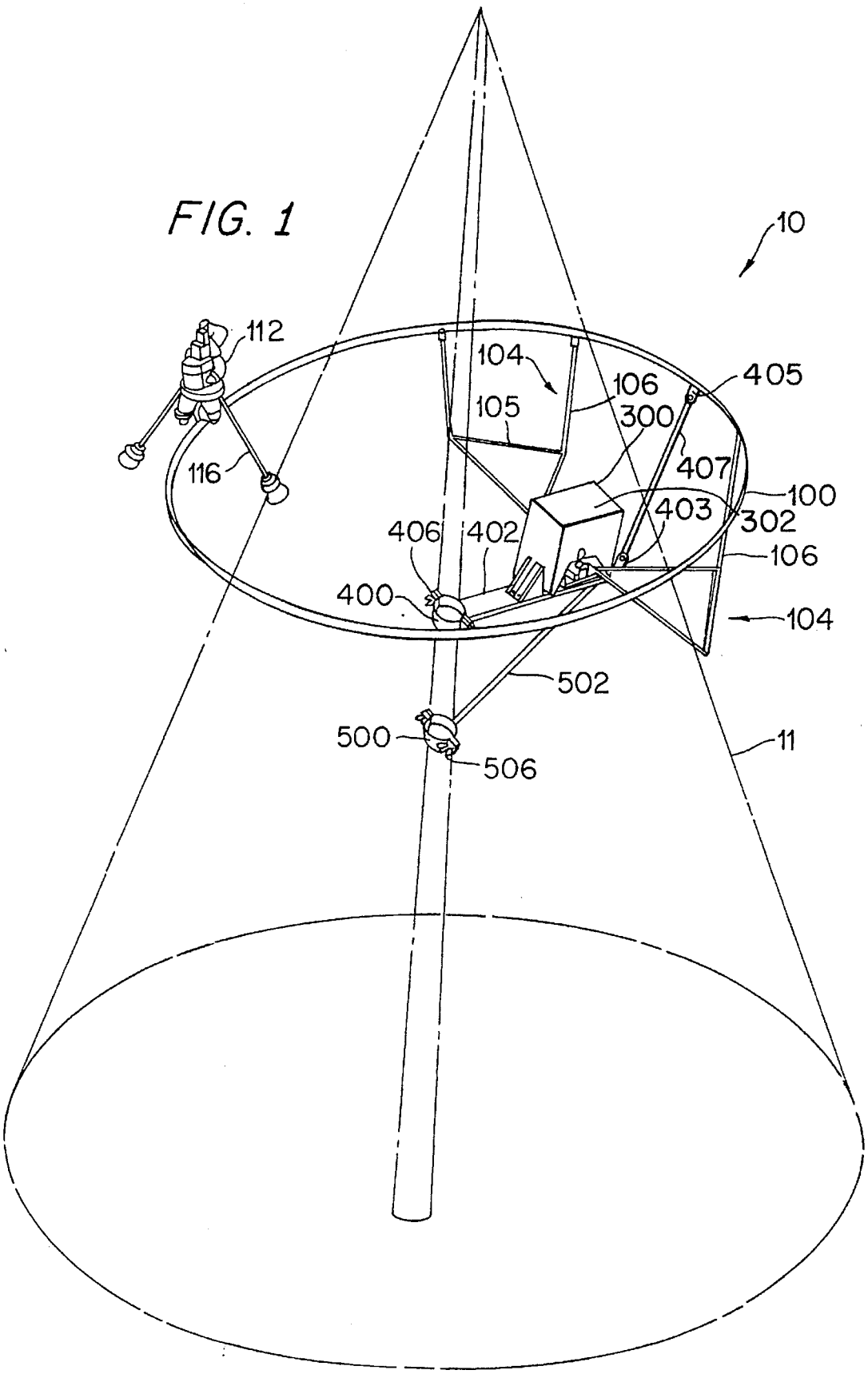
FIG. 1 is a perspective view of an animated display in accordance with the present invention mounted on a tree shown in broken lines.

FIG. 1 depicts a display apparatus 10 in accordance with one embodiment of the present invention. In this embodiment, the display apparatus is mounted on a tree 11 shown in long-and-short dashed lines. The display apparatus 10 generally includes a rigid track, or hoop, 100 supported by linking members 104 and "undulated" in a manner to continuously propel a toy FIG. 112, such as a unicycling Santa, around the track. The linking members are secured to a motion-transmitting mechanism 300 that itself is mounted to the trunk of the tree by a clamp member 400, and operates to impart such "undulating" motion to the track 100.

The "undulating" motion of the track 100 produced by the motion-transmitting mechanism, in a manner described in detail below, results in points on the track being cyclically raised and lowered progressively around the track circumference. Therefore, the term "undulating" as used in this specification and concluding claims means that the successive points about the circumference of the track are cyclically raised and lowered thereby to simulate a traveling wave about that circumference. As also will be explained below, the toy FIG. 112 is propelled about the track by riding in front of this travelling, rising and subsequently falling, wave.

In the preferred embodiment, the hoop 100, shown in FIG. 1, is circular, surrounds the tree and serves as a rigid track around which the toy figure may travel. The hoop may be made in two interlocking halves or be made of one solid piece of metal, wood, rigid plastic, or the like. The hoop must be sufficiently strong and rigid to serve its intended purpose of bearing the weight of the toy figure without deforming, bending or breaking. In one embodiment, for example, the hoop is made of two interlocking metal halves forming a smooth joint to permit the figure to roll over the joints without becoming derailed. Of course, non-circular continuous shapes may be substituted for that shown in the figures.

The hoop 100 is undulated by the motion-transmitting mechanism motor, to be described in greater detail later, whose drive force is transmitted to the hoop through branched linking members 104.

Figure 2:
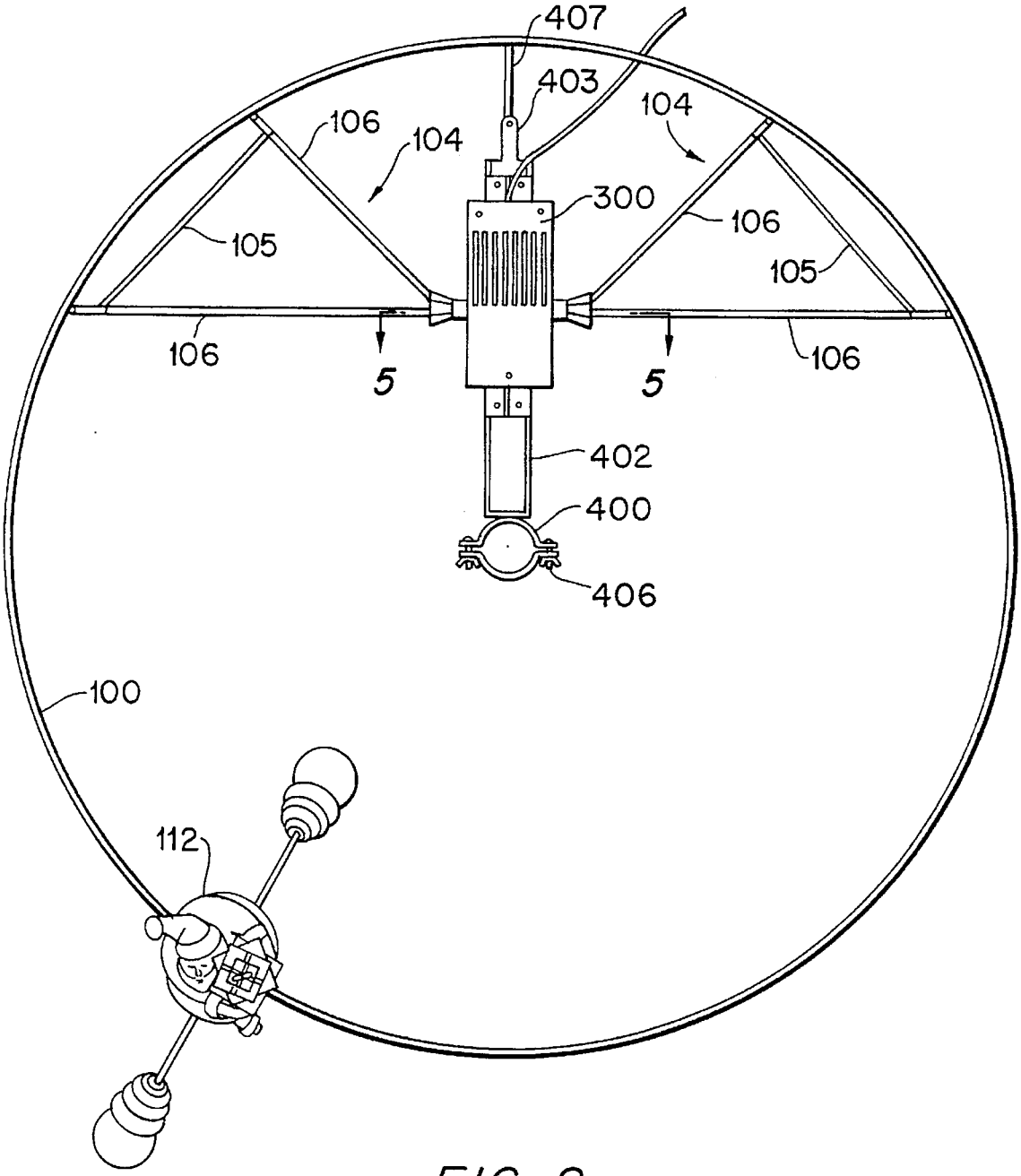
FIG. 2 is a top plan view of the display in accordance with the present invention.
Figure 3:
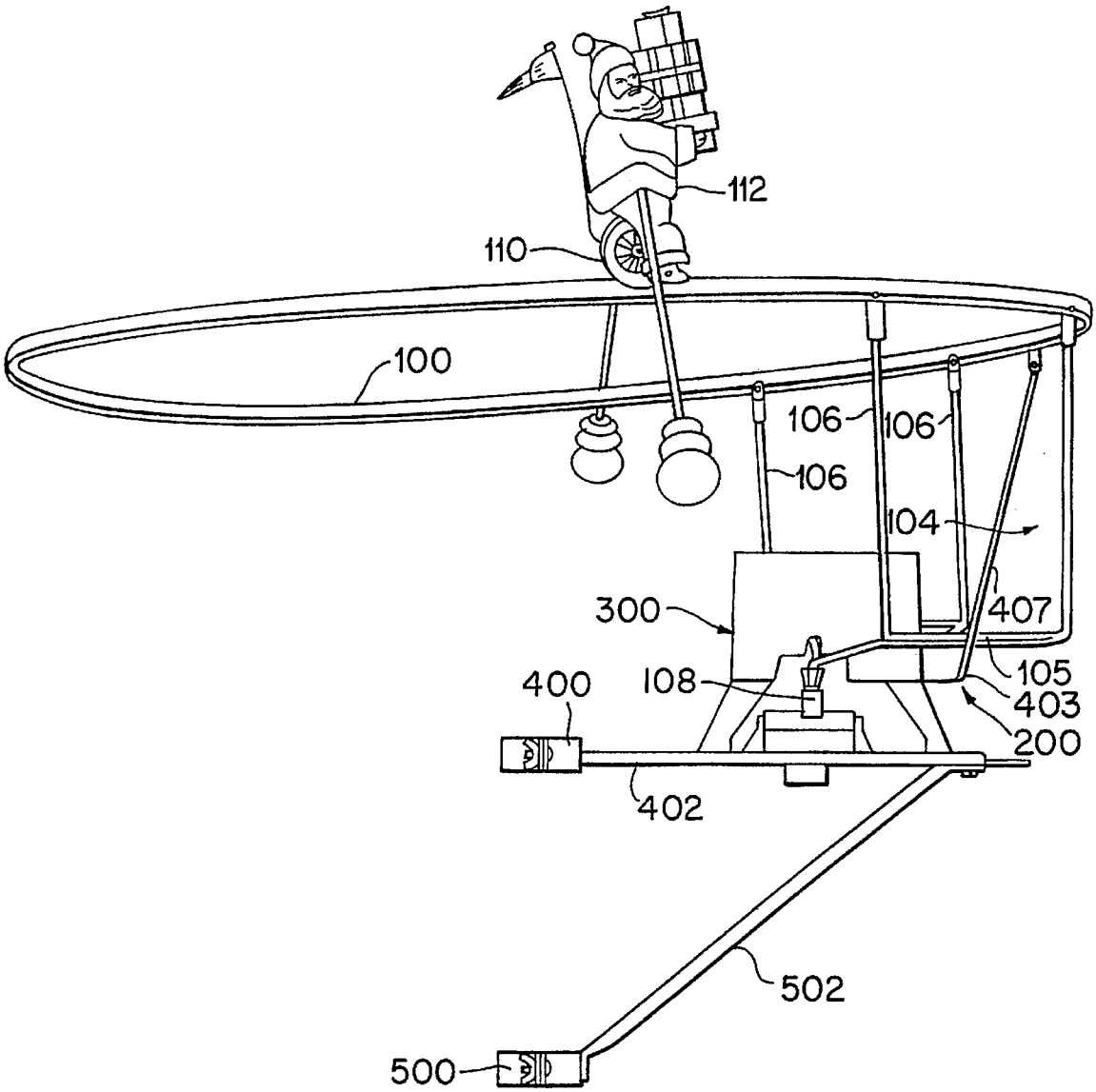
FIG. 3 is a side view of the display in accordance with the present invention.

As shown generally in FIGS. 1 through 3, each branched linking member 104 includes, in this embodiment, two arms 106 for supporting the hoop. The arms can be stabilized by a connecting rod 105. As will be appreciated, the linking members 104 are moved about two transverse axes by the motion-transmitting mechanism 200 as described below in detail. This motion is transmitted through the arms 106 to undulate the hoop 100 to produce motion as described above.

Figure 8:
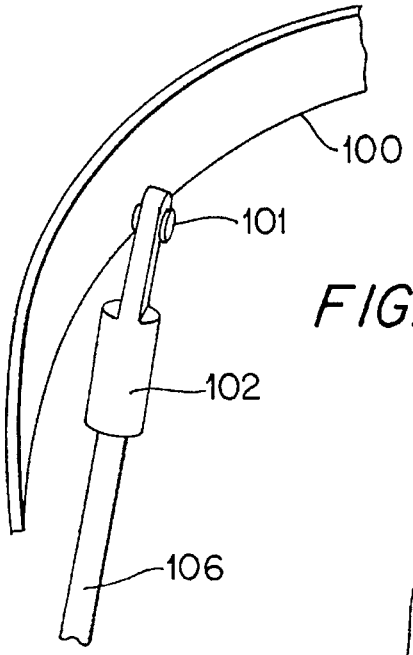
FIG. 8 is a partial perspective view of a mounting pole used to connect a support arm to a rigid track in accordance with the present invention.

As shown in detail in FIG. 8, one end of each arm 106 is detachably connected to hoop 100 by inserting the end into a cylindrical cavity formed inside a corresponding mounting pole 102 provided on the lower portion of one side of the hoop. The mounting poles are fastened to the hoop by fasteners 101 to permit the mounting poles to rotate about the point of fastening. The arms 106 on each of two branched linking members 104 are constructed so that the distance between them equals the distance between the mounting poles 102 in each pair.

Figure 9:
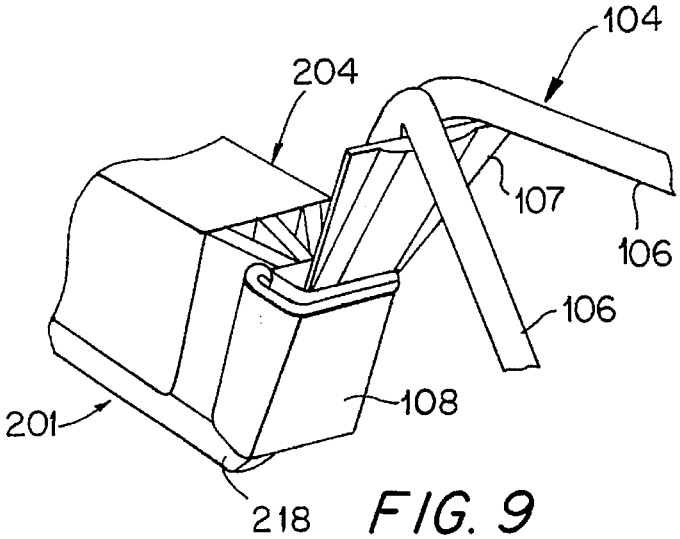
FIG. 9 is a partial perspective view of a connection between a branched linking member and a pivoting member of the compound pivot mechanism in accordance with the present invention.

As best seen in FIGS. 2 and 9, both arms 106 of each linking member 104 terminate at a stabilizing plate 107 and are connected at this end to a U-shaped bracket 108 which is secured to a pivoting member 204 of the motion-transmitting mechanism 200.

Figure 4:
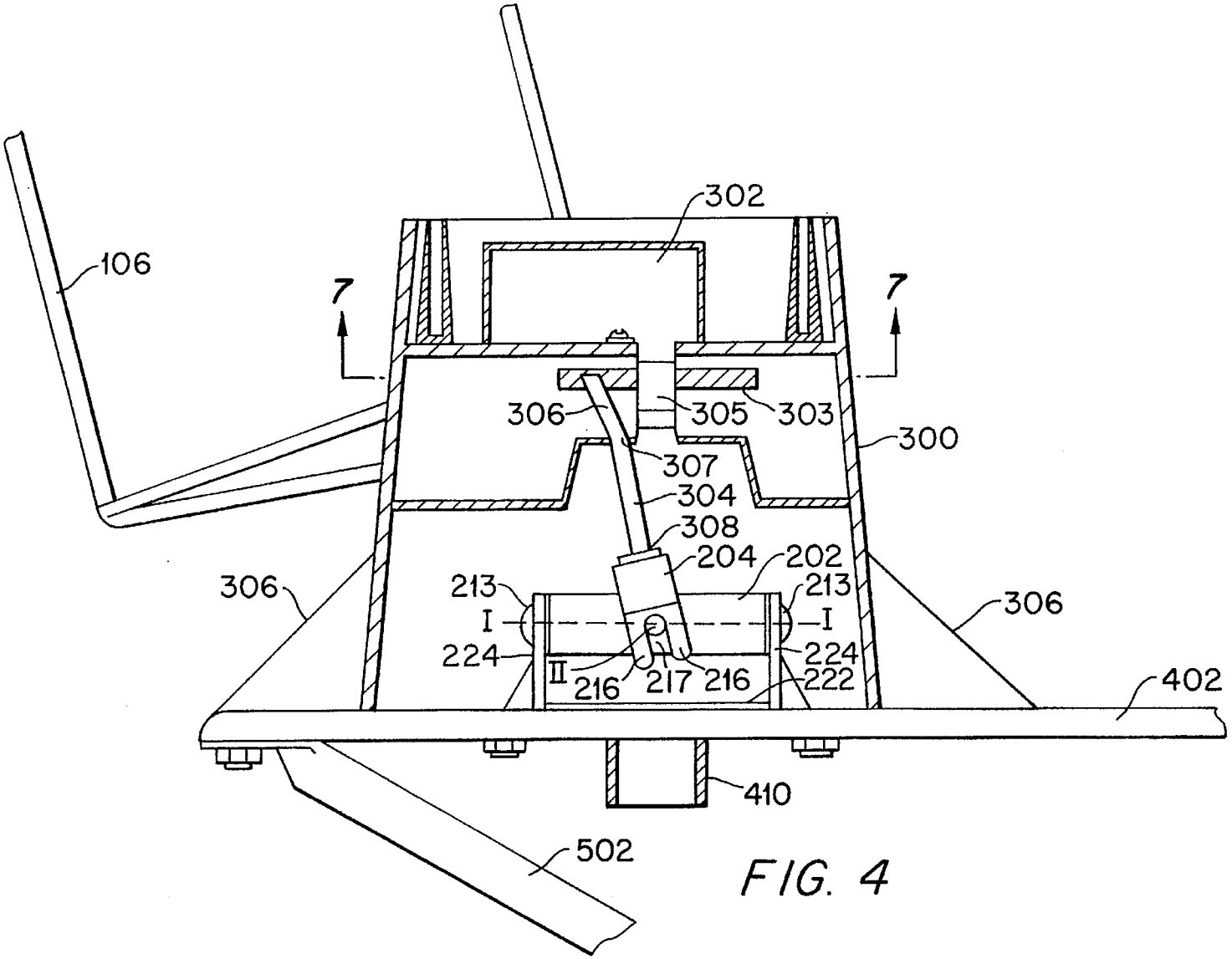
FIG. 4 is a sectional view showing a motor drive transmission portion of the display in accordance with the present invention.
Figure 5:
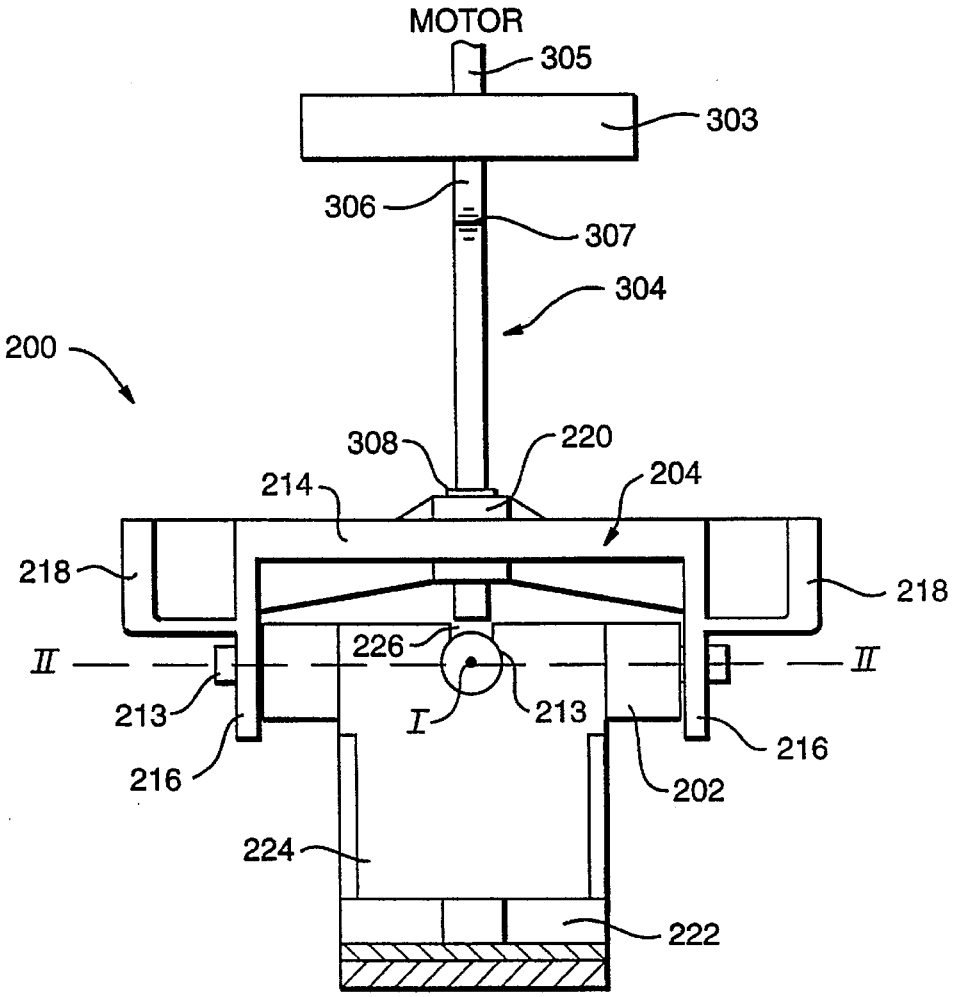
FIG. 5 is a cross-sectional view of a compound pivoting mechanism in accordance with the present invention viewed along plane 5—5 shown in FIG. 2.
Figure 6:
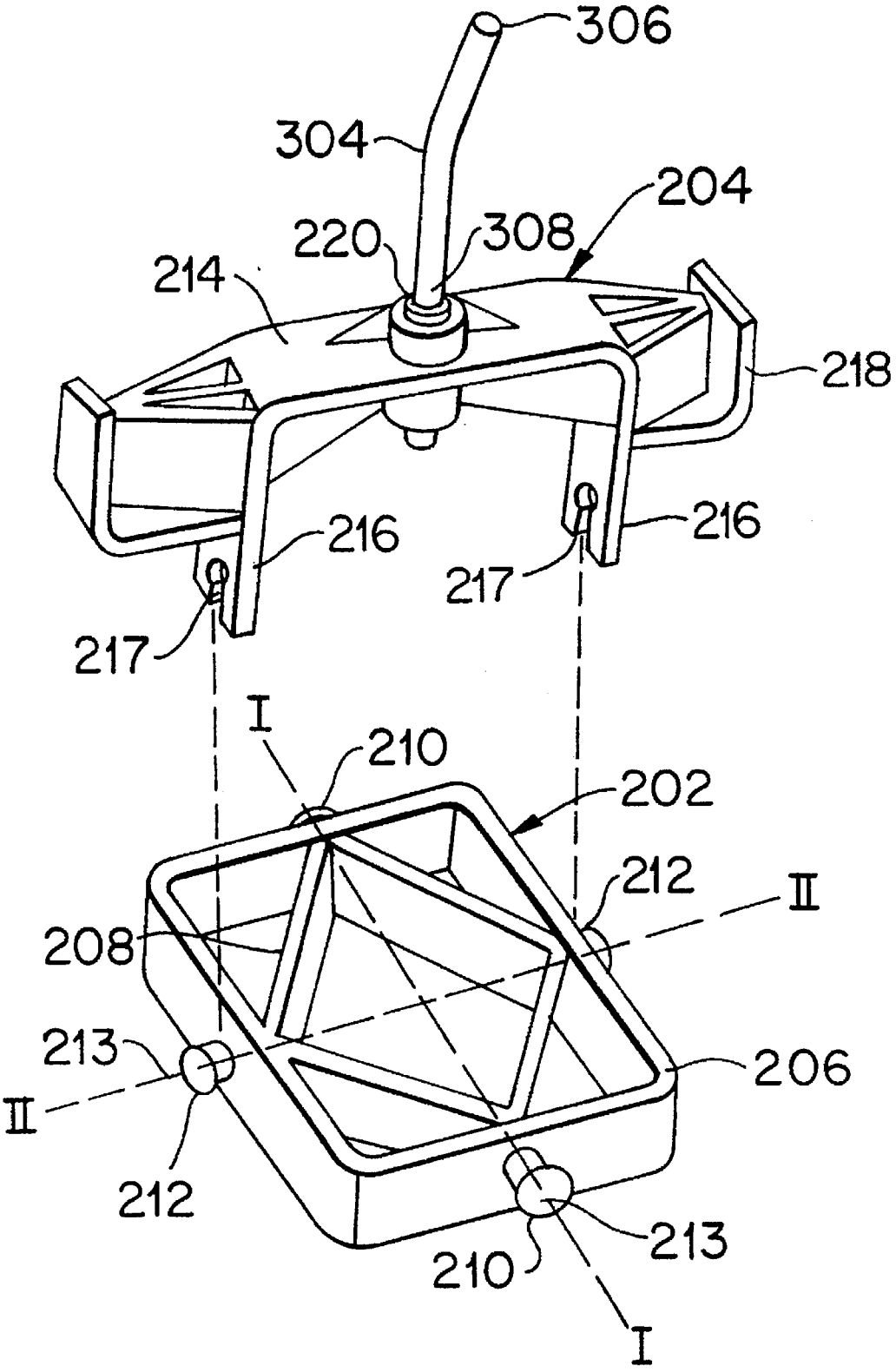
FIG. 6 is an exploded perspective view of two pivoting components of the compound pivot mechanism in accordance with the present invention.

The motion-transmitting mechanism 200 is best seen in FIGS. 4, 5 and 6 and includes, as a primary component, a compound pivot mechanism 201 capable of pivoting motion about a first axis I—I and a second axis II—II. The two pivoting components of the compound pivot are a first pivot member 202 that pivots about the first axis I—I, which is fixed in the mechanism 200, and a second pivot member 204 which pivots about the second axis II—II, which is positioned in the first pivot member 202 for pivoting motion therewith. In the preferred embodiment, the axes are mutually perpendicular and intersect, but may otherwise be skewed.

As shown best in FIG. 6, the first pivot member 202 includes a frame 206, which in this embodiment is rectangular in shape, having stiffening ribs 208. A first set of pivot pins 210 extend from the frame in the first axis I—I, and a second set of pivot pins 212 extend from the frame to define the second axis II—II.

The second pivot member 204 includes a generally inverted U-shaped frame 214 with depending legs 216 for connection to the first pivot member 202. Each leg includes a slot 217 for receiving one of the second set of pins 212. In this manner, the second pivot member is pivotally supported on the first pivot member and can pivot about the second axis II—II. As best seen in FIG. 6, widened ends 213 on the pivot pins prevent excess lateral movement of the first and second pivot members. L-shaped receiving members 218 extend from opposite ends of the second pivot member for receiving the U-shaped brackets 108 of the linking members 104 as described above. A collar 220 in the frame 214 receives and fixes a first end of a shaft or pin 304 through which the compound pivot mechanism is driven as described in detail below.

With reference now to FIGS. 4 and 5, the first pivot member 202 itself is pivotally supported by a base member 222 that is fastened to, or formed integrally with, a frame member 402, to be described later. The base member includes legs 224 extending upwardly from the frame member. The legs include notches 226 for receiving the first set of pivot pins 210 such that the first pivot member 202 can pivot about the first axis I—I.

It will be appreciated that the first and second pivot members, in turn mounted on the base, may be considered a gimbal.

A motor 302, shown in FIG. 4, which drives the compound pivot mechanism, or gimbal, in the manner described below, may be any AC or DC motor sufficiently small and lightweight so that it may be supported by the arrangement described herein without destabilizing the tree or placing undue stress on the trunk or branches. The motor must also be capable of supplying sufficient power to operate the rigid track as described below.

Figure 7:
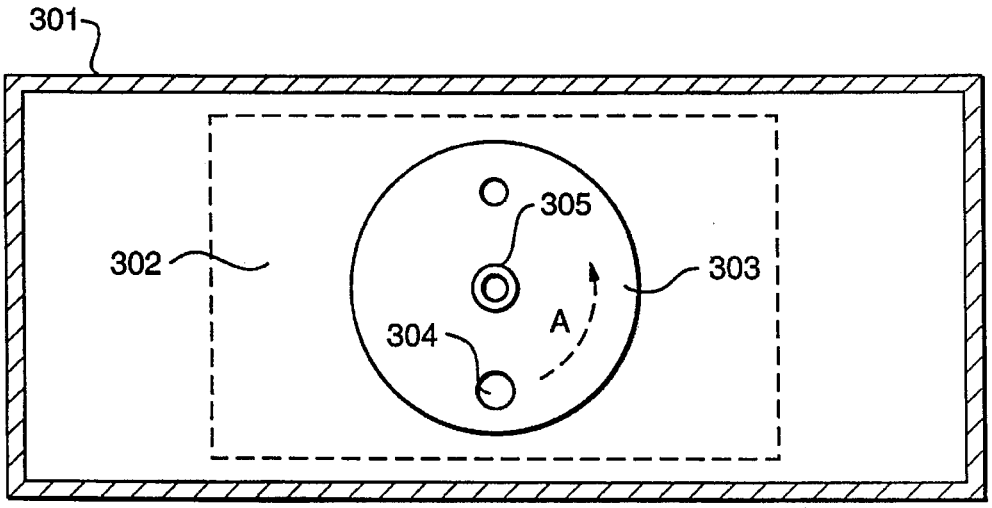
FIG. 7 is a cross-sectional view showing the motor drive transmission portion in accordance with the present invention viewed along plane 7—7 in FIG. 4.

The motor 302 rotates a plate 303 mounted on the motor drive shaft 305 in, for example, a counterclockwise direction indicated by arrow A shown in FIG. 7. As shown in FIGS. 4, 5, and 6, a second end 306 of the pin 304 is journalled eccentrically in a hole in the plate 303, so that rotation of motor drives the first end of the shaft in a substantially circular path.

The pin 304 includes a bent, or angled, portion 307 though this configuration is not essential. The pin 304 thus rotates about the axis of the motor to circumscribe a cone as the second end of the pin is rotated by the motor.

It will be understood, then, that as the pin 304 is driven by the motor and plate, the second pivot member 204 is continuously reciprocally pivoted back and forth about the second axis II—II defined in the first pivot member 202. Simultaneously the first pivot member 202 is continuously reciprocally pivoted back and forth about the first axis I—I defined in the base 224. This simultaneous compound pivoting motion results in continuous undulating pivoting of the receiving members 218 extending from the second pivot member, thereby to produce similar continuous undulating motion of the hoop or track mounted on the second pivot member through the link members.

Stated another way, this compound continuous simultaneous motion of the first and second pivot members is transferred to the rigid track through the linking members to cause cyclical raising and lowering of contiguous points on the track, creating an undulating wave-like motion. This motion of the track will cause the figure mounted on wheel 110 to roll continuously around the track in front of the rising and subsequently falling wave.

By attaching the feet of the figure to pedals 114, the figure can be made to appear to be pedalling around the hoop. Balance members 116 extending from each side of the figure in a conventional manner aid in the proper balance of the figure.

Figure 10:
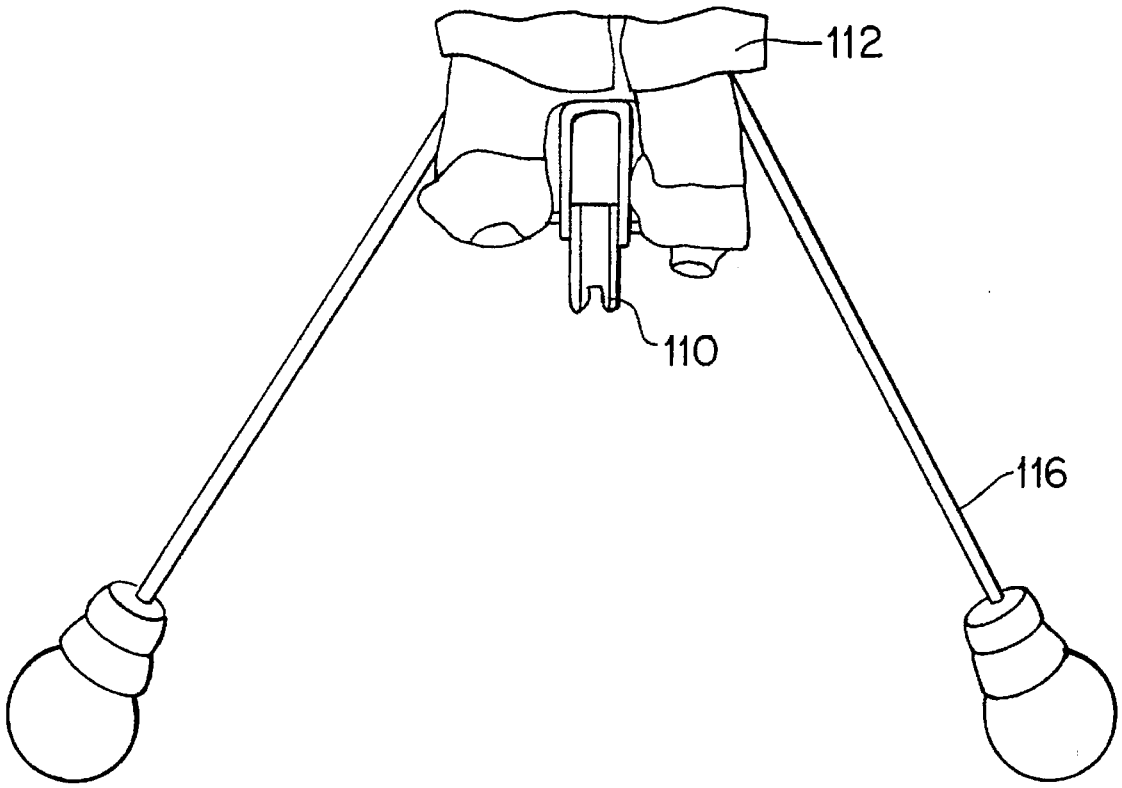
FIG. 10 is a partial front elevational view illustrating one example of a toy figure mounted on a wheel having a channel or groove sized to embrace the rigid track in accordance with the present invention.

FIG. 10 illustrates one example of a wheel 110 on which the toy FIG. 112 may be mounted. The wheel has a groove sized to accommodate or embrace the hoop so that the wheel can travel around the hoop as the hoop undulates.

In FIG. 1, the apparatus 10 is shown attached to a vertical support using an adjustable clamp member 400, which fits around the trunk of a tree. Fasteners 406, such as bolts and wing nuts, allow the clamp to be securely fastened to the trunk of the tree.

Extending from the clamp member 400, as can also be seen in FIGS. 2 through 4, is frame member 402 sized to accommodate housing 300 with motor 302 and the combination pivot mechanism 201 for operating the hoop 100.

The frame member may have a rearwardly projecting tab 403 and the hoop 100 may have a complementary depending tab 405. An elastic cord 407 is connected in tension between the tabs 403 and 407. The cord 407 acts as counterbalance for the hoop, particularly when the FIG. 112 is riding on the hoop in the region diametrically opposed to the tab 405, as shown, for example, in FIGS. 1 and 2.

Extending downwardly at an angle from the frame member 402 is second frame member 502. Adjustable clamp member 500 formed at the free end of frame member 502 also accommodates the tree trunk or other vertical support. Fasteners 506, which may also be bolts and wing nuts, allow the clamp to be securely fastened to the tree trunk. Thus, the tree trunk or other vertical support and frame members 402 and 502 form substantially a triangle to provide support sufficient to hold the remainder of the display.

As discussed above, frame member 402 supports motor housing 300. As shown in FIGS. 1, 3 and 4, the housing includes leg members 306 extending downwardly to feet members 308 which are fastened to frame member 402 using screws or the like. Alternately, housing 300 may be integrally molded with frame member 402.

Figure 12:
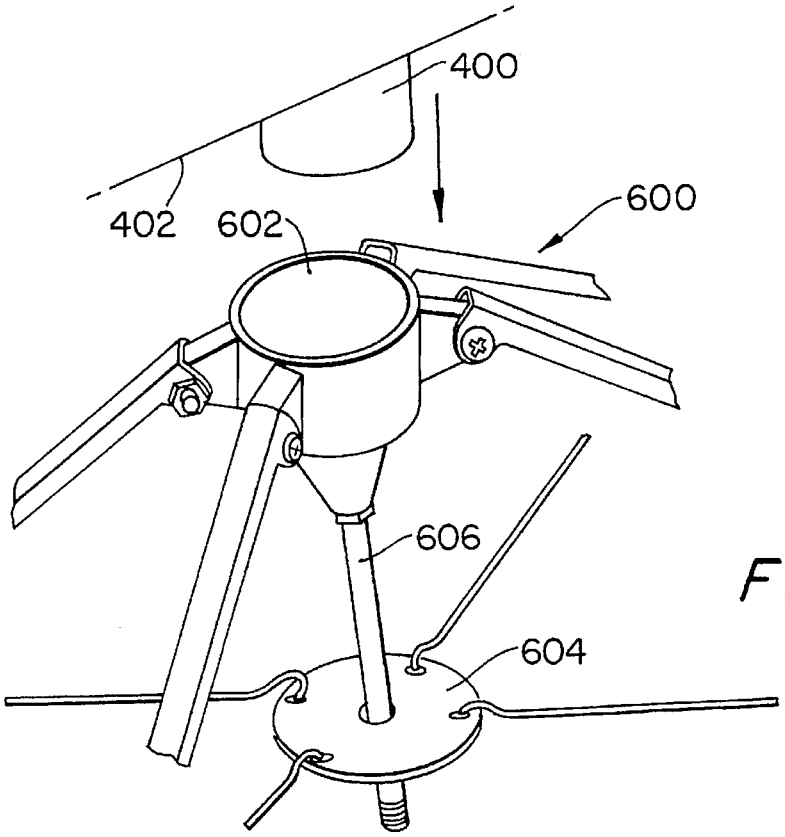
FIG. 12 is a partial perspective view of a portion of the stand shown in FIG. 11 in accordance with the present invention.
Figure 11:
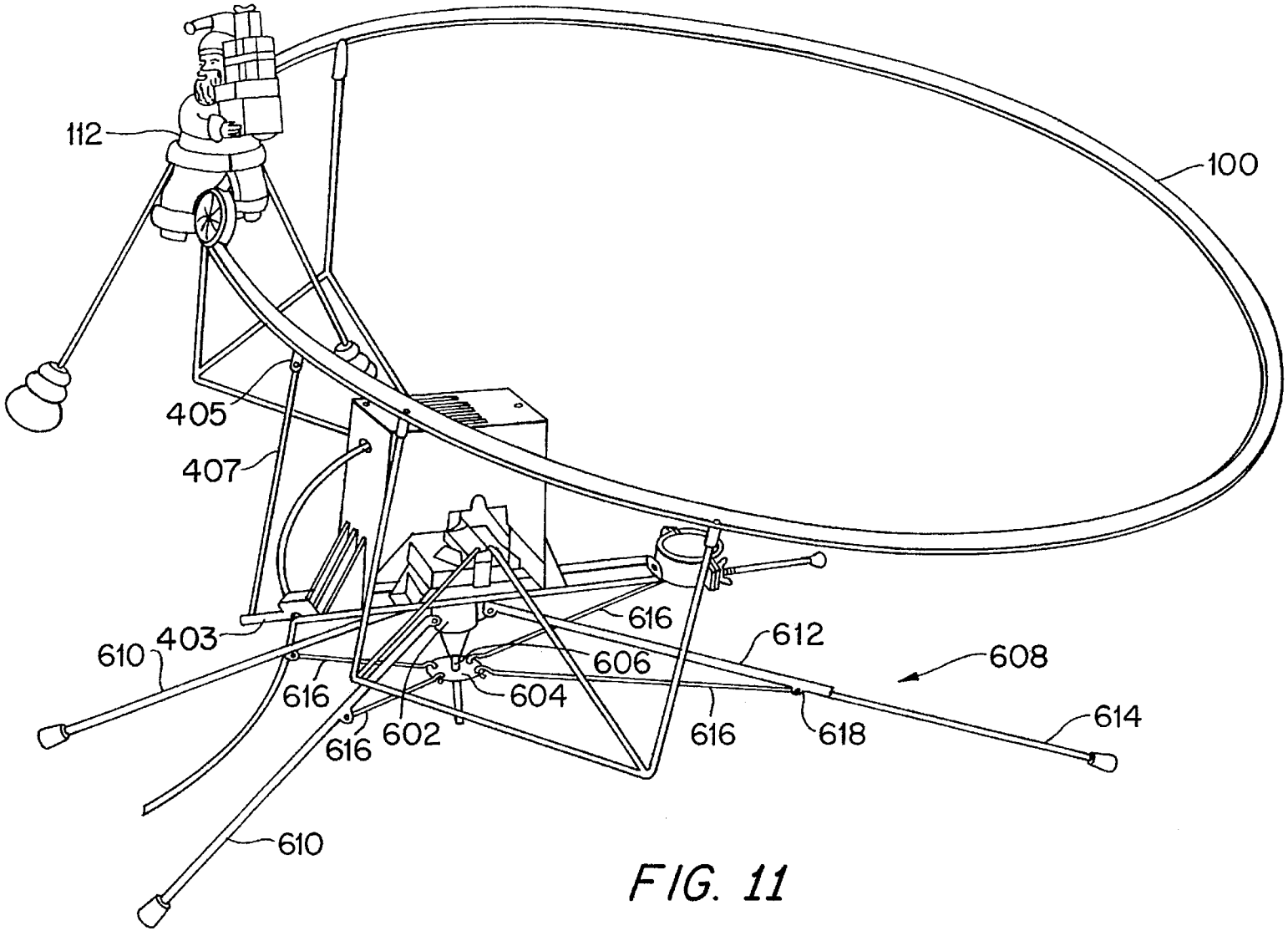
FIG. 11 is a perspective view of the display mounted on a stand for use on a flat surface in accordance with the present invention.

The overall apparatus 10 may also be adapted for display on a flat surface using a mounting attachment 600, such as that shown in FIGS. 11 and 12, upon detachment of second frame member 502. The mounting attachment is connected to frame member 402 through a tubular plug 410 formed in the frame member 402. The tubular plug can also be seen in FIG. 4.

A stand head 602 receives the tubular plug on the frame member 402. Stand head 602 is mounted to stringer plate 604 via an elongated screw 606. Feet 608 and 610 buttress the mounting system. Feet 608 include support portions 612 and 614 joined, along with latch 616, at a joint 618 using, for example, a screw and nut. Feet 610 and support portions 612 of feet 608 are attached to stand head 602 using, for example, a screw and nut. Latches 616 hook through holes formed in the stringer plate 604. As can be seen from FIG. 11, this arrangement forms triangular support portions between the feet, latches, and screw 606 for stable support on a flat surface.

Although specific embodiments of the present invention have been described above in detail, it will be understood that this description is merely for purposes of illustration. Various modifications of, and equivalent structures corresponding to, the disclosed aspects of the preferred embodiments, in addition to those described above, may be made by those skilled in the art without departing from the spirit of the present invention which is defined in the following claims, the scope of which is to be accorded the broadest interpretation so as to encompass such modifications and equivalent structures.

What is claimed is:

1. A display, comprising:

a rigid, continuous, closed track;

motion-transmitting means for imparting undulating motion to said rigid track, said motion-transmitting means including a compound pivot mechanism producing continuous, simultaneous pivoting motion about a fixed first axis and about a second axis different from said first axis; and connecting means for connecting said rigid track to said compound pivot mechanism to pivot about the second axis, wherein continuous simultaneous pivoting motion produced by said compound pivot mechanism about the first and second axes imparts undulating motion to said track.

2. A display according to claim 1, wherein said compound pivot mechanism includes a first pivot member mounted to pivot about the first axis and a second pivot member mounted on the first pivoting member to pivot about the second axis.

3. A display according to claim 2, wherein said motion-transmitting means includes drive means and link means having one end rigidly connected to said second pivot member and a second end driven in a non-linear, closed path by said drive means.

4. A display according to claim 3, wherein said drive means drives said second end of said link means to pivot said second pivot member about the second axis and simultaneously to pivot said first pivot member about the first axis.

5. A display according to claim 2, wherein said compound pivot mechanism includes a fixed base defining the first axis, said first pivot member being mounted for pivoted movement on said base about the fist axis and defining the second axis, said second pivot member being mounted for pivoted movement on said first pivot member about the second axis.

6. A display according to claim 1, wherein said connecting means includes a plurality of extension members connecting said motion-transmitting mechanism to said track.

7. A display according to claim 6, wherein each of said plurality of extension members comprises a pair of arms, each of said arms being secured to said rigid track about a single axis.

8. A display according to claim 1, further comprising a first adjustable attachment means for attaching said motion-transmitting means to a vertical support member.

9. A display according to claim 8, further comprising:

a buttressing member extending from said motion-transmitting means to said vertical support member; and a second adjustable attachment means for attaching said buttressing member to said vertical support member.

10. A display according to claim 1, further comprising a stand on which said motion-transmitting mechanism is detachably mountable for supporting said motion-transmitting mechanism on a substantially horizontal surface.

11. A display according to claim 1, further comprising figurine means configured to ride on said track, said figurine means being driven around said track by the undulating motion thereof.

12. A display according to claim 11, wherein said figure means includes a wheel formed to embrace said track and roll there along when driven by the undulating motion thereof.

13. A display, comprising:

a rigid, continuous, closed track;

undulation drive means, connected to said track, for moving said track in an undulating manner, said undulation drive means including a compound pivot mechanism producing simultaneous pivoting motion about first and second mutually perpendicular axes, said rigid track being connected to primarily pivot about the second axis and secondarily pivot about the first axis; and figuring means configured to roll on said track, said figurine means being driven around said track by the undulating motion thereof.

14. An display according to claim 13, wherein said compound pivot mechanism includes a first pivot member supported to pivot about the first axis and a second pivot member supported to pivot about the second axis.

15. A display according to claim 14, wherein said undulation drive means include motor means and link means having one end connected to said second pivot member and a second end driven in a non-linear closed path by said motor means.

16. A display according to claim 15, wherein motor means drives said second end of said link means to pivot said second pivot member about the second axis and simultaneously to pivot said first pivot member about the first axis.

17. The display device according to claim 16, further comprising a pin having one end fixedly connected to said second pivot member and a second end, said drive means including means for driving said second end of said pin in a non-linear path.

18. The display device according to claim 17, wherein said drive means comprises a motor for producing rotary motion, a plate rotationally driven by said motor, said second end of said pin being journalled in said plate.

19. The display device according to claim 16, further comprising figurine means configured to ride on said track, said figurine means being driven around said track by the undulating motion thereof.

20. The display device according to claim 19, wherein said figurine means include a wheel formed to embrace said track and roll there along when driven by the undulating motion thereof.

21. The display device according to claim 16, further comprising means for mounting said motion-transmitting means on a vertical support such as the trunk of a tree.

22. The display device according to claim 16, further comprising means for supporting said motion-producing means on a substantially horizontal surface.

23. A display according to claim 13, wherein said undulating drive means includes linking members linking said rigid track to said compound pivoting mechanism, said linking members being secured to said rigid track.

24. A display device, comprising:

a rigid continuous, closed track;

motion-transmitting means for imparting continuous undulating motion to said track, said motion-transmitting means comprising a compound pivot mechanism defining a first fixed axis, a first pivot member mounted to pivot reciprocally about the first axis and defining a second axis different from the first axis, a second pivot member mounted to pivot reciprocally about the second axis, and drive means for simultaneously driving said second pivot member to pivot continuously reciprocally about the second axis and said first pivot member to pivot continuously reciprocally about the first axis; and connecting means for connecting said track to said second pivot member;

wherein simultaneous drive of said first and second pivot members by said drive means imparts continuous undulating motion to said track.

25. The display device according to claim 24, wherein the first and second axes are mutually perpendicular.

26. The display device according to claim 24, wherein the first and second axes intersect.

27. The display device according to claim 24, wherein compound pivot mechanism is a gimbal.

* * * * *

UNITED STATES PATENT AND TRADEMARK OFFICE

CERTIFICATE OF CORRECTION

PATENT NO. : 5,632,107

DATED : May 27, 1997

INVENTOR(S) : HUANG MENG-SUEN ET AL.

It is certified that error appears in the above-identified patent and that said Letters Patent is hereby corrected as shown below:

[57] ABSTRACT

Line 6, "an" should read --a--.

COLUMN 2

Line 44, "In another" should read --Another--.

COLUMN 7

Line 30, "fist" should read --first--.
Line 58, "figure" should read --figurine--.
Line 60, "there along" should read --therealong--.

COLUMN 8

Line 6, "figuring" should read --figurine--.
Line 9, "An" should read --A--.
Line 35, "include" should read --includes--.
Line 36, "there along" should read --therealong--.

UNITED STATES PATENT AND TRADEMARK OFFICE

CERTIFICATE OF CORRECTION

PATENT NO. : 5,632,107

DATED : May 27, 1997

INVENTOR(S) : HUANG MENG-SUEN ET AL.

It is certified that error appears in the above-identified patent and that said Letters Patent is hereby corrected as shown below:

COLUMN 8 CONTINUED

Line 44-45, "undulating" should read --undulation--.

Signed and Sealed this

Eighteenth Day of November 1997

*Attest:*

*Attesting Officer*

BRUCE LEHMAN

*Commissioner of Patents and Trademarks*